US005644793A

United States Patent [19]

Lahaussois et al.

[11] Patent Number: 5,644,793

[45] Date of Patent: Jul. 8, 1997

[54] DISPENSIBLE, DISPOSABLE REVERSIBLE FOREARM PROTECTOR

[75] Inventors: Pierre Lahaussois, Darien; Margaret T. Strohl, Ridgefield, both of Conn.

[73] Assignee: Dale Strohl, Ridgefield, Conn.; a part interest

[21] Appl. No.: 603,283

[22] Filed: Feb. 20, 1996

Related U.S. Application Data

[63] Continuation-in-part of Ser. No. 269,149, Jun. 30, 1994, Pat. No. 5,542,121.

[51] Int. Cl.[6] ..... A41D 13/08; A41B 13/10

[52] U.S. Cl. ..... 2/59; 2/60; 2/16; 2/49.1

[58] Field of Search ..... 2/16, 59, 60, 49.1, 2/50, 170, 125, 61, 62, 48, 49.4, 52

[56] References Cited

U.S. PATENT DOCUMENTS

| | | | |
|---|---|---|---|
| D. 232,134 | 7/1974 | Andersson et al. | 2/49.1 |
| D. 232,276 | 8/1974 | Andersson et al. | 2/49.1 |
| 1,360,840 | 11/1920 | White . | |
| 2,058,040 | 10/1936 | Severn | 2/59 |
| 2,832,074 | 4/1958 | Wheeler | 2/16 |
| 3,189,919 | 6/1965 | Chase | 2/16 |
| 3,299,440 | 1/1967 | Grable | 2/49.1 |
| 3,452,363 | 7/1969 | Schultz | 2/49.1 |
| 3,657,741 | 4/1972 | Blanco | 2/59 |
| 3,916,447 | 11/1975 | Thompson | 2/46 |
| 4,014,046 | 3/1977 | Craig | 2/60 |
| 4,186,443 | 2/1980 | Britzman | 2/49.1 |
| 4,504,978 | 3/1985 | Gregory, Jr. et al. | 2/59 |
| 4,677,697 | 7/1987 | Hayes | 2/159 |
| 4,856,112 | 8/1989 | Effle | 2/59 |
| 4,893,372 | 1/1990 | Wenzel | 2/16 |
| 4,916,757 | 4/1990 | Berlin et al. | 2/159 |
| 4,928,322 | 5/1990 | Bradfield | 2/158 |
| 4,964,176 | 10/1990 | Previdi | 2/242 |
| 5,063,919 | 11/1991 | Silverberg | 2/59 |
| 5,187,813 | 2/1993 | Klein | 2/16 |
| 5,392,786 | 2/1995 | Lewis et al. | 2/16 |
| 5,402,536 | 4/1995 | Matthews | 2/59 |

FOREIGN PATENT DOCUMENTS 128715 1/1929 Switzerland .

*Primary Examiner*—Amy B. Vanatta

*Attorney, Agent, or Firm*—Schweitzer Cornman Gross & Bondell LLP

[57] ABSTRACT

A dispensable, disposable reversible forearm protector is made up from continuous webs of composite material. Each of two laminated webs, comprised of a layer of soft, absorbent paper toweling or the like and a moisture impermeable layer of thermoplastic or similar material, is arranged face-to-face with the other and joined by heat sealing or other means along generally transverse strip-like bonding areas of the web to form rectangular or trapezoidal segments of the web. Lines of weakness running along the strip-like bonding areas allow successive segments to be detached from the web. Each segment forms a flat, tubular element, which is expandable to circular form so as to receive the hand and forearm of a user. The device may be easily turned inside-out, so that the respective layers of absorbent material and moisture impermeable material may be placed on the inside or the outside as desired. The bonding area at one side may be relatively weaker, allowing the bond at that side to be separated and the tubular article to be opened to flat form. Secondary lines of weakness, provided along the edge margin of the weakened bond, define separable, flexible tie strips, allowing the article to be alternatively employed as a bib or small apron. The device is economical to produce and convenient to use and dispose of.

6 Claims, 4 Drawing Sheets

FIG. 3
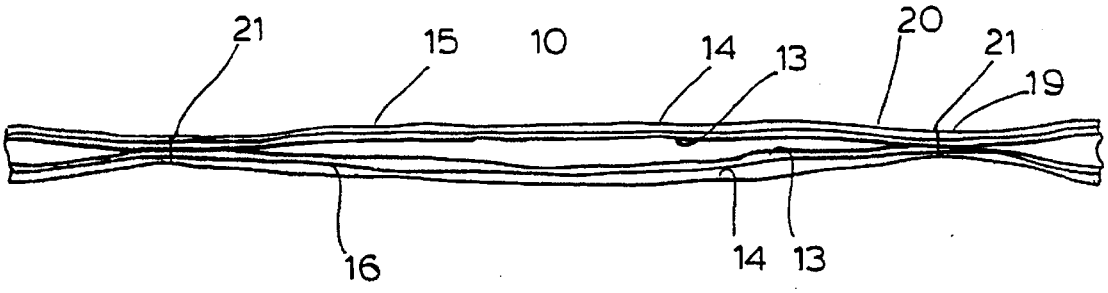
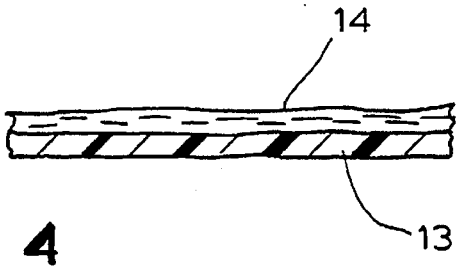
FIG. 4
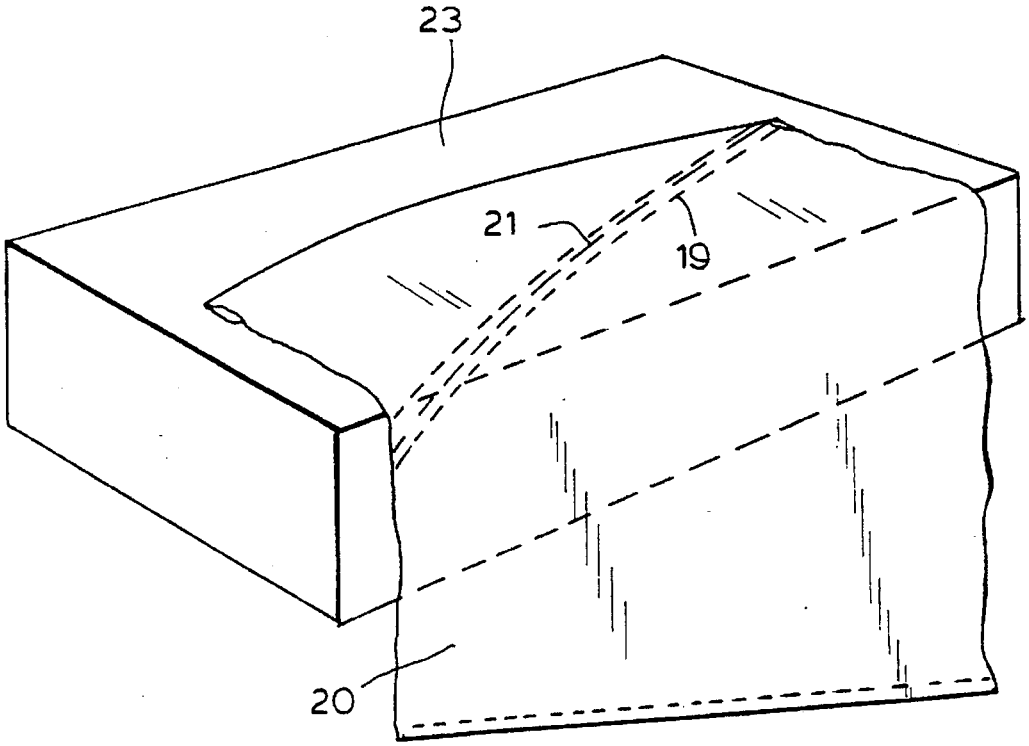
FIG. 5

FIG.9
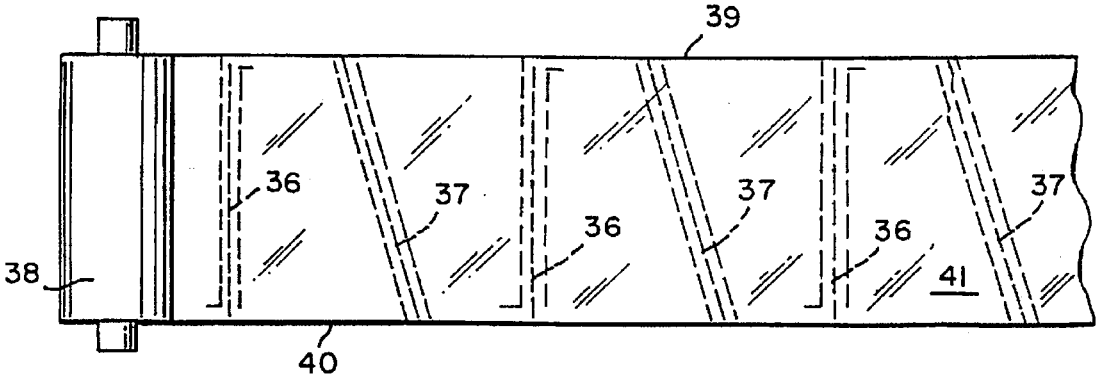
FIG.10
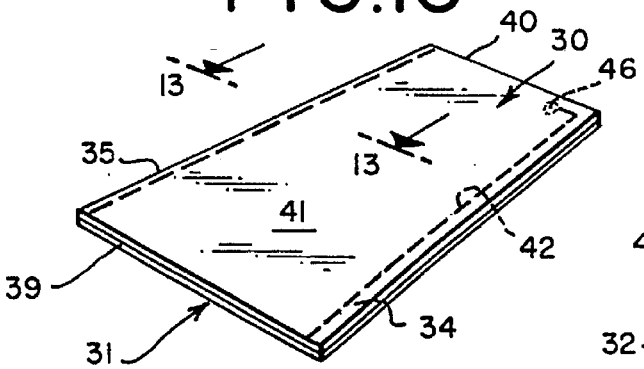
FIG.11
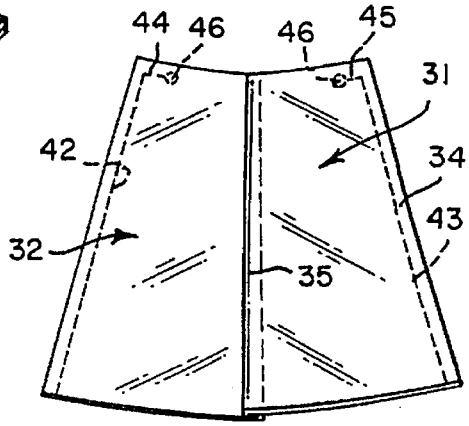
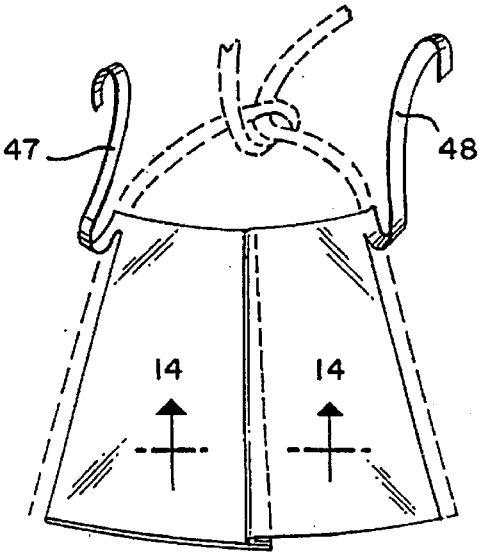
FIG.12
FIG.13
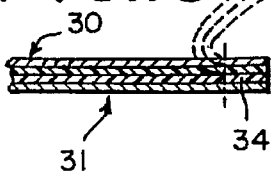
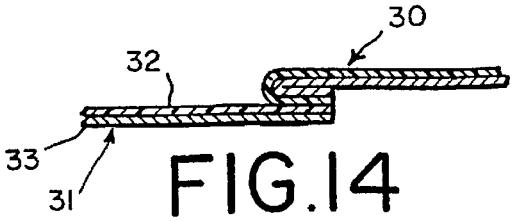
FIG.14

DISPENSIBLE, DISPOSABLE REVERSIBLE FOREARM PROTECTOR

RELATED APPLICATIONS

This application is a continuation-in-part of our U.S. patent application Ser. No. 269,149, filed Jun. 30, 1994 [140-007] now U.S. Pat. No. 5,542,121.

BACKGROUND AND SUMMARY OF THE INVENTION

There is a need in certain areas of endeavor for the use of a protective covering for the forearm. Such a device is usefully employed by, for example, artists, craftsmen, cooks and other food processors, medical personnel and the like, who handle liquid or semi-liquid materials. There are examples in the prior art of devices useful for this purpose. However, insofar as we are aware, all of the prior art devices suffer from certain shortcomings, either in the area of performance, high cost, difficulty or inconvenience of use, or combinations of one or more of the foregoing.

In our above mentioned copending application, a simple, highly effective, reversible forearm cover device is disclosed, which is inexpensive to produce, conveniently dispensed and utilized, and easily disposed of. In one preferred embodiment of the invention, a protective web material is formed of a composite laminate comprised of a plastic film on one side and paper toweling on the other. Two such composite webs are arranged face-to-face, with the plastic film layers on the inside, and the composite web laminates are joined together along spaced-apart, strip-like bonding areas by heat sealing or otherwise. The strip-like bonding areas extend along generally transverse lines to form successive sections of flat tubular form. Lines of weakness extend transversely along the bonding areas, to enable successive flat tubular sections to be torn free of an otherwise continuous supply of the web material. Preferably, individual tubular sections of the material are formed of trapezoidal configuration, narrower at one end than the other, to conform better to typical forearm contours. Where desired, elastic or expandable bands may be provided separately, for securing the forearm protectors snugly to the wearer during use.

In a particularly advantageous embodiment of the invention, the forearm protector is constructed in a way that enables it to be employed alternatively as a forearm-protector, as a mat, or as a bib. In this respect, the device of the invention comprises opposed, preferably trapezoidally shaped sections, of a film-paper toweling composite laminate. The two sections are heat sealed with the film sides in face-to-face relation and with the heat seal bond along one side being of narrow width and/or weakly bonded. The arrangement is such that, if the user prefers to employ the unit as a mat or a bib, the initially tubular unit is opened by separating the heat seal along the weakly bonded edge, allowing the two sections, still joined along one edge, to be opened to a generally flat configuration.

Secondary lines of weakness, initially formed along the opened edges of the device can be partially torn free, extending from the bottom edges of the bib to a point near the upper edges thereof. These partially separated strips form convenient flexible tie strips for securing the article around the user's neck, in the form of a bib. The construction of the unit according to the invention enables it to be conveniently used in an alternative manner, as a forearm protector, a protective mat, or as a bib, as the user chooses.

The device of the invention may be easily dispensed in continuous roll form, or from a box. If desired, the protector devices may be pre-cut and dispensed individually.

For a more complete understanding of the above and other features and advantages of the invention, reference should be made to the following detailed description of preferred embodiments of the invention and to the accompanying drawings.

IN THE DRAWINGS

FIG. 3 is an enlarged cross sectional view as taken generally on line 3—3 of FIG. 2.

FIG. 4 is a further enlargement of a section of FIG. 3 illustrating the laminated construction of a preferred material used in the invention.

FIG. 5 is a perspective illustration of a device according to the invention employed with a box style of dispenser.

FIG. 9 is a plan view of a roll supply of another preferred form of the invention, useful alternatively as a forearm protector, a mat, or a bib.

FIG. 10 is a perspective view of a single article detached from the roll supply of FIG. 10 showing a single article in its initial, tubular form.

FIG. 11 is a plan view of the article of FIG. 10 in an opened-up configuration, in which it can be used as a flat protector, such as a mat, or further prepared for use as a bib.

FIG. 12 is a plan view of the article of FIG. 11, with lateral strips along the outside edges partially torn free, to form flexible ties, converting the article to a bib.

FIG. 13 is an enlarged, fragmentary, cross sectional view as taken generally on line 13—13 of FIG. 10.

FIG. 14 is a cross sectional view of the section of FIG. 13, with the respective layers of material opened up to the configurations of FIGS. 11 or 12.

DESCRIPTION OF PREFERRED EMBODIMENTS

Figure 1:
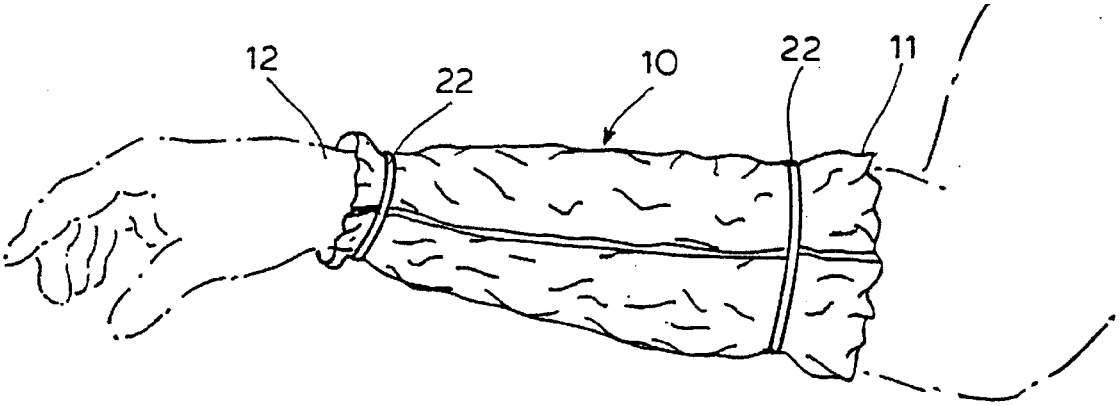
FIG. 1 is a representative view of a forearm protector according to one preferred form of the invention as applied over a user's forearm.

Referring now to the drawing, and initially to FIGS. 1–4, the reference numeral 10 designates generally a forearm protector according to one aspect of the invention, which preferably is in the form of a tapered, tubular sleeve, open at each end 11, 12 and adapted to be received over the hand and forearm of the user. To advantage, the tubular sleeve 10 is formed of a laminated material, with a thin layer of moisture impermeable plastic (preferably thermoplastic) film 13 on the inside and a layer of absorbent paper toweling or similar material 14 on the outside. The laminated material desirably is produced in the form of continuous webs 15, 16.

As shown in FIG. 3, a pair of continuous webs 15, 16 is arranged in superposed relation, with the respective thermoplastic webs in face-to-face contact. The respective webs 15, 16 are then joined together from one edge 17 to the other edge 18 along narrow, generally transverse strip-like bonding areas 19. Typically, the joining is accomplished by heat sealing techniques, although suitable adhesive or solvent bonding, for example, could also be employed. Desirably, successive bonding areas 19 along the length of the web material are oriented at opposite shallow angles with respect to a transverse axis, such that each section 20, between successive sealing areas 19, is in the form of a trapezoid.

Figure 2:
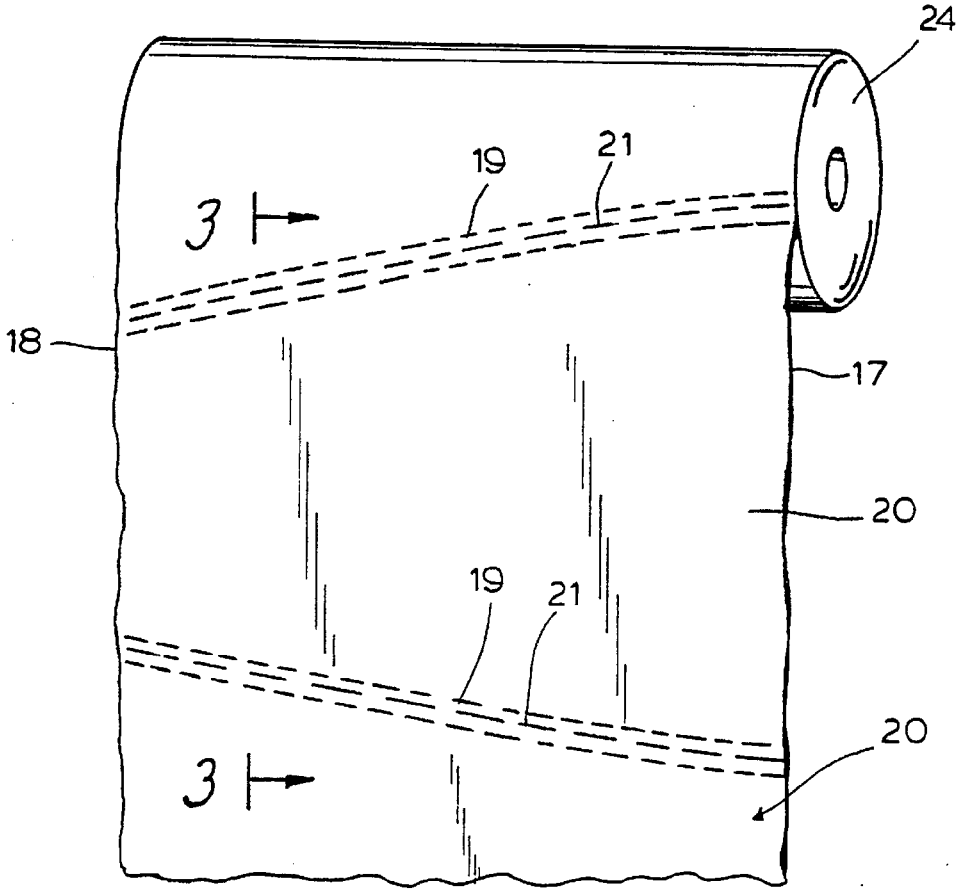
FIG. 2 is a perspective view of a roll supply of forearm protectors of FIG. 1.

In the illustration of FIG. 2, the composite web material is supplied in a continuous roll form, and lines of weakness 21, such as lines of perforation, score lines or the like, are provided more or less centrally within the bonding areas 19, to allow individual segments 20 to be torn away from the roll supply, much the same as individual paper towels are torn away from their supply rolls.

Preferably, the individual composite webs 15, 16 are formed by laminating the respective webs of absorbent toweling and plastic film over their full surfaces. However, where preferred, the webs may be bonded together in limited areas, possibly only at the edge bands 19.

The product of FIG. 2 is utilized by tearing off the endmost segment 20 and opening the tubular section formed thereby to the configuration of a tapered open tube of generally circular cross section. The hand of the user is inserted into the larger end of the tapered tube and passed entirely through the tube until the sleeve is positioned on the user's forearm as shown in FIG. 1. Typically the spacing between successive bonding areas 19 is such that the tapered sleeve formed thereby is large enough to fit over a relatively large forearm. Accordingly, the supply of protective sleeves may include elastic or expandable bands 22, one or more of which can be slipped over the protective sleeve to hold it in position on the user's forearm.

In the form of the invention shown in FIG. 5, a continuous web-form supply of detachable sleeve sections 20 is supplied in a dispensing box 23, instead of a continuous roll 24 as in FIG. 2. In general, however, the utilization is the same as with the roll supply of FIG. 2, in that individual sections 20 are torn off of the web supply along predefined lines of weakness 21 formed in the strip-like bonding areas 19.

Where desired, the individual sleeve sections 20 may be precut from the web supply and furnished in a dispenser box 23, much in the manner of box-dispensed facial tissues, for example.

In a modified and particularly advantageous form of the invention, shown in FIGS. 9–14, the reversible protective sleeve device is constructed and configured to have additional functions as a bib or a mat. The modified device is formed of opposed upper and lower composite webs 30, 31, each comprising an inner layer 32 of thermoplastic material and an outer layer 33 of paper-toweling or similar material. As in the case of the previously described embodiment, the upper web sections 30 are joined with the lower web sections 31 by bonding of the respective thermoplastic layers 32 along marginal edge portions 34, 35. Conveniently, a plurality of articles thus formed are joined along lines of weakness 36, 37 to form a continuous web supply, fed from a roll 38, from which individual articles may be detached along successive lines of weakness 36, 37.

To accommodate the shape of the forearm, the individual sections, separated by the lines of weakness 36, 37, are of trapezoidal form defining a wider end 39 for reception over the upper forearm and a narrower end 40 for reception over the wrist portion of the user. The respective lines of weakness 36, 37 may be oriented as shown in FIG. 9, in which the lines 36 are perpendicular to the length of the web, while the lines 37 are disposed at an acute angle, or they may be arranged as shown in FIG. 2, where the lines of weakness at opposite sides are symmetrically convergently oriented.

Figure 8:
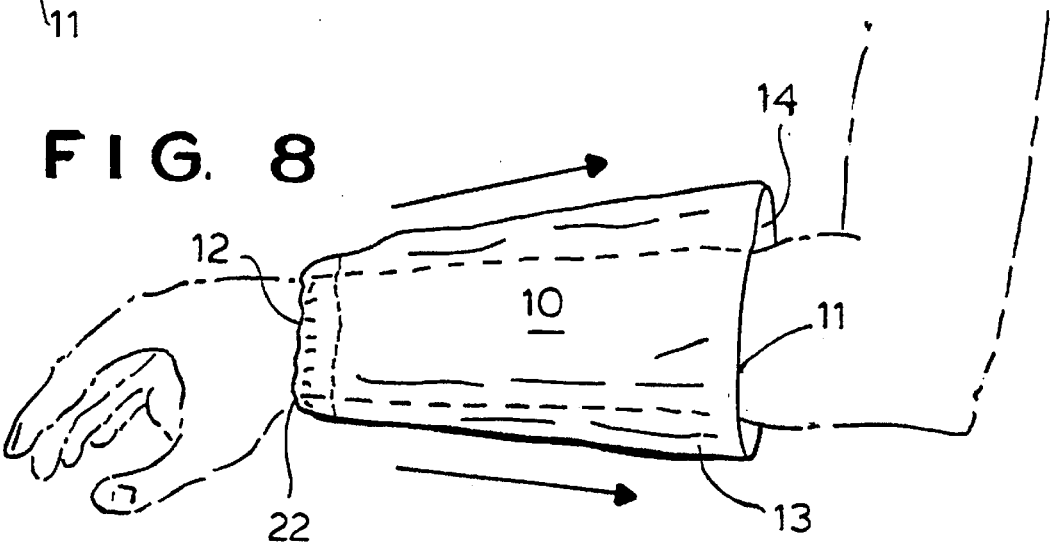

When an individual article 41 is detached from the roll supply, it may be utilized in the same manner as reflected in FIGS. 1 and 8 of the drawing, for example, as a forearm protector. In the article of FIGS. 9–14, however, there are additional features which provide for optional alternative uses of the article. Thus, in the article of FIGS. 9–14, the bonding of the respective upper and lower composite webs along the edge margins 34 is formed with a relatively low bond strength, such that the respective upper and lower web sections may be separated along the weakly bonded margin without tearing or destruction of the individual web sections 30, 31. The bond along the opposite side edge margin 35 is intended to be permanent, and may be made as strong as desired.

For one alternate usage, the upper and lower webs 30, 31 may be separated along the weakly bonded margin 34 and folded open along the opposite margin 35, as reflected in FIGS. 11 and 14. When thus opened, the article may be conveniently employed as a protective mat, for example, with the thermoplastic film layer 32 facing upward or downward, as the user desires.

Additionally, the article of FIGS. 9–14 is provided with secondary lines of weakness extending along the weakly bonded margin 34. The secondary lines of weakness 42, 43 are spaced inward from and are generally parallel to the primary line of weakness 36 along which the article is separated from the continuous supply. The secondary lines of weakness extend from the wider end 39 of the article to a point near but spaced from the narrow end 40. Desirably, the secondary lines of weakness have short portions 44, 45 extending inwardly at right angles, parallel to the narrower end of the article, and terminating, if desired, at a reinforcement 46.

As shown in FIG. 12, the secondary lines of weakness 42, 45 define separable flexible tie strips 47, 48, which the user may separate from the body of the article by tearing along the secondary lines of weakness, in the manner shown in FIG. 12. These tie strips can be secured behind the neck of the user, to form a bib. They also can be secured in belt loops or the like, to form a small apron-like article.

The reversible protective sleeve device of the invention is useful to great advantage by individuals dealing with liquid or semi-liquid materials. Where there is frequent need to wipe the hands and/or utensils with a minimum interruption in the ongoing work, the absorbent paper layer provides a convenient medium. By way of example, excessive liquid can be removed from a small paintbrush by simply wiping it across a forearm protected with one of the protecting sleeves. The liquid materials is readily absorbed by the outer surface of paper toweling, while the plastic liner prevents penetration to the inside of the sleeve.

Figure 7:
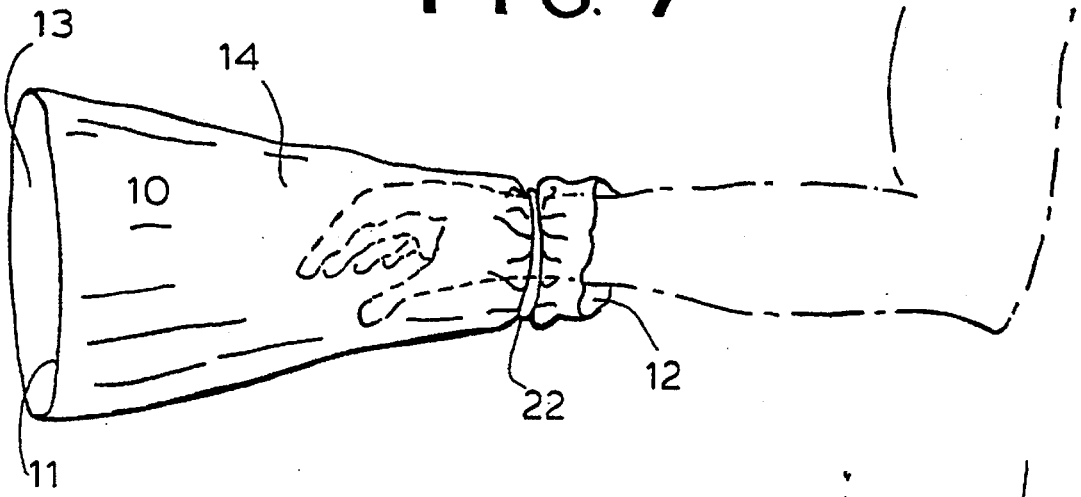
FIGS. 6–8 are a sequence of views illustrating the manner in which the forearm protector of the invention is applied in a reverse or inside-out orientation.
Figure 6:
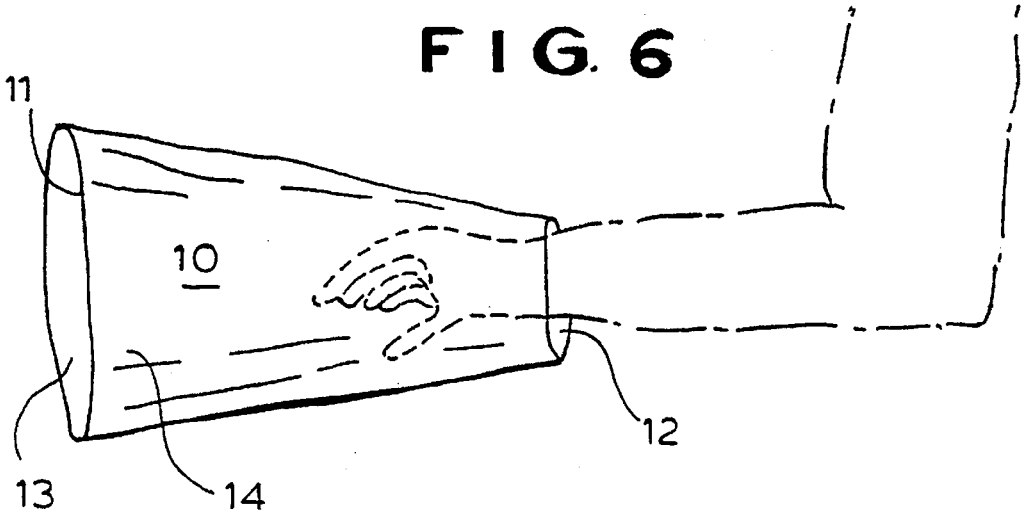

For certain tasks, such as pottery throwing, certain cooking operations, etc., it may be unnecessary, or perhaps even undesirable to provide for liquid absorption on the exterior of the protective sleeve. In such cases, the sleeve can be utilized in a reverse orientation, as shown in FIGS. 6–8. For this manner of use, the sleeve protector, in its normal, paper outside orientation, is applied over the forearm small end first, which is opposite to the normal application. An elastic or expandable band 22 is applied over the sleeve end 12, substantially as shown in FIG. 7, causing the end of the sleeve protector to be lightly gripped about the wrist or the outer forearm of the user. Next, the large diameter (outer) end of the sleeve protector is gripped and drawn over the forearm, in the manner shown in FIG. 8. In the process, the sleeve protector is turned inside out, with the absorbent paper layer on the inside and the water impervious plastic layer on the outside.

The modified form of the article, as shown in FIGS. 9–14, the utility is significantly enhanced by providing for alternative uses of the article as a mat or bib. By providing for a weakly bonded margin along one side edge, the user has the option of separating the layers at the weakly bonded interface and opening up the two layers into a generally flat configuration. To particular advantage, the modified article is formed along the weakly bonded edge margin with secondary lines of weakness which, when torn, form flexible tie strips which remain anchored at one end of the article. The tie strips can be secured around the neck to form a bib or may be suitably secured at the waist to form a small apron, for example. The opened-up article can also be employed conveniently as a mat, for protecting surfaces from wet materials.

Although a laminated sleeve material comprised of paper toweling and thermoplastic film is ideal for most uses, it may be appropriate in some cases to utilize single materials, such as the film alone or the paper toweling alone, depending upon the service for which the device is intended to be used.

The device of the invention is highly simplified, economical to manufacture, easy to use and easy to dispose of. The materials can be produced in continuous forms by joining of separate laminates in face-to-face relation, along narrow, generally transverse strip-like bonding areas, with lines of weakness being provide along the bonding areas to accommodate separation of individual sections at the time of use.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A convertible sleeve protector device comprising (a) first and second sections of sheet-like material of similar size and shape and having first and second end edges and opposite side edges, (b) said first and second sections being joined along said opposite side edges only, to form a normally flat structure openable to tubular configuration to accommodate insertion of a user's hand and forearm, (c) said sections being joined along one of said opposite side edges, along side edge margins of the respective sections, with a bond that is separable without tearing of the sheet-like material forming said sections, (d) said sections being joined along the other of said opposite side edges with a permanent bond, (e) said sections of sheet-like material, upon separation of said separable bond, being openable to a generally flat, single layer form, with said sections remaining joined along the other of said side edges and adapted for an alternative use.

2. A convertible sleeve protector device comprising (a) first and second sections of sheet-like material of similar size and shape and having first and second end edges and opposite side edges, (b) said first and second sections being joined along said opposite side edges only, to form a normally flat structure openable to tubular configuration to accommodate insertion of a user's hand and forearm, (c) said sections being joined along one of said side edges, along side edge margins of the respective sections, with a bond that is separable without tearing of the sheet-like material forming said sections, (d) said sections of sheet-like material, upon separation of said bond, being openable to a generally flat, single layer form, with said sections remaining joined along the other of said side edges and adapted for an alternative use, (e) each of said sections of sheet-like material being formed with a line of weakness, extending along the one side edge thereof adjacent to and spaced from a side edge extremity of said section, to form a tear-away flexible strip, (f) said line of weakness extending from one end edge to a terminal point adjacent to but spaced from the other end edge.

3. A convertible sleeve protector device according to claim 7, wherein (a) each said line of weakness extends to a point spaced from said other end edge and then extends away from said one side edge toward the other and to said terminal point, whereby said tear-away flexible strip has a first portion extending along a side edge of a sheet-like section and a second portion extending along the said other end edge thereof.

4. A convertible sleeve protector device according to claim 7, wherein (a) a reinforcement is provided at the terminal point of each said line of weakness.

5. A convertible sleeve protector device comprising (a) first and second sections of sheet-like material of similar size and shape and having first and second end edges and opposite side edges of straight configuration, (b) said first and second sections being joined along said opposite side edges only, to form a normally flat structure openable to tubular configuration to accommodate insertion of a user's hand and forearm, (c) said sections being joined along one of said opposite side edges, along side edge margins of the respective sections, with a bond that is separable without tearing of the sheet-like material forming said sections, (d) said sections being joined along the other of said opposite side edges with a permanent bond, (e) said sections of sheet-like material, upon separation of said separable bond, being openable to a generally flat, single layer form, with said sections remaining joined along the other of said side edges and adapted for an alternative use, (f) said sections of sheet-like material each comprise a layer of flexible thermoplastic material and a layer of absorbent material, (g) said sections being joined with the respective layers of thermoplastic material in face to face relation.

6. A convertible sleeve protector device according to claim 8, wherein (a) said sections of sheet-like material are provided in continuous web form, with individual sections thereof being joined along lines of weakness, whereby individual protector devices may be torn away from a continuous supply thereof.

* * * * *